US005329466A

United States Patent [19]

Monney

[11] Patent Number: 5,329,466

[45] Date of Patent: Jul. 12, 1994

[54] REGISTRATION CONTROL DEVICE FOR USE IN A ROTARY PRINTING MACHINE

[75] Inventor: Patrick Monney, Villars-Ste-Croix, Switzerland

[73] Assignee: Bobst SA, Lausanne, Switzerland

[21] Appl. No.: 974,526

[22] Filed: Nov. 12, 1992

[30] Foreign Application Priority Data

Nov. 14, 1991 [CH] Switzerland ..... 03318/91-5

[51] Int. Cl.[5] ..... G01B 11/14

[52] U.S. Cl. ..... 364/559; 250/548

[58] Field of Search ..... 101/181, 248, 151, 136, 101/206, 485, 486; 364/559; 250/548

[56] References Cited

U.S. PATENT DOCUMENTS

| | | | |
|---|---|---|---|
| 3,653,322 | 4/1972 | Richardson . | |
| 4,366,753 | 1/1983 | Glanz et al. | 101/181 |
| 4,484,522 | 11/1984 | Simeth | 101/181 |
| 4,736,680 | 4/1988 | Wales et al. | 101/181 |
| 4,857,745 | 8/1989 | Gough | 101/181 |
| 4,887,530 | 12/1989 | Sainio | 101/181 |
| 4,972,088 | 11/1990 | Weyer et al. . | |
| 5,076,163 | 12/1991 | Sainio . | |
| 5,115,141 | 5/1992 | Gold . | |

FOREIGN PATENT DOCUMENTS

| | | |
|---|---|---|
| 0123305 | 10/1984 | European Pat. Off. . |
| WO86/05141 | 9/1986 | PCT Int'l Appl. . |
| WO89/01867 | 3/1989 | PCT Int'l Appl. . |

*Primary Examiner*—Jack B. Harvey
*Assistant Examiner*—Thomas Peeso
*Attorney, Agent, or Firm*—Hill, Steadman & Simpson

[57] ABSTRACT

A register control device has a head which scans registration marks printed on a web, the scanning head having a row of discrete photosensitive elements arranged crosswise to the traveling direction of the web and in a plane situated above and parallel to the web. The scanning head has in the same plane a linear video bar situated parallel to the row of photosensitive elements. The device includes a microprocessor which selects the photosensitive element to be used according to the temporary sideways displacement of the web and controls the scanning operations of the linear video bar. The scanning head may also include a second row of discrete photosensitive elements arranged parallel between the first row of discrete photosensitive elements and the linear video bar.

13 Claims, 1 Drawing Sheet

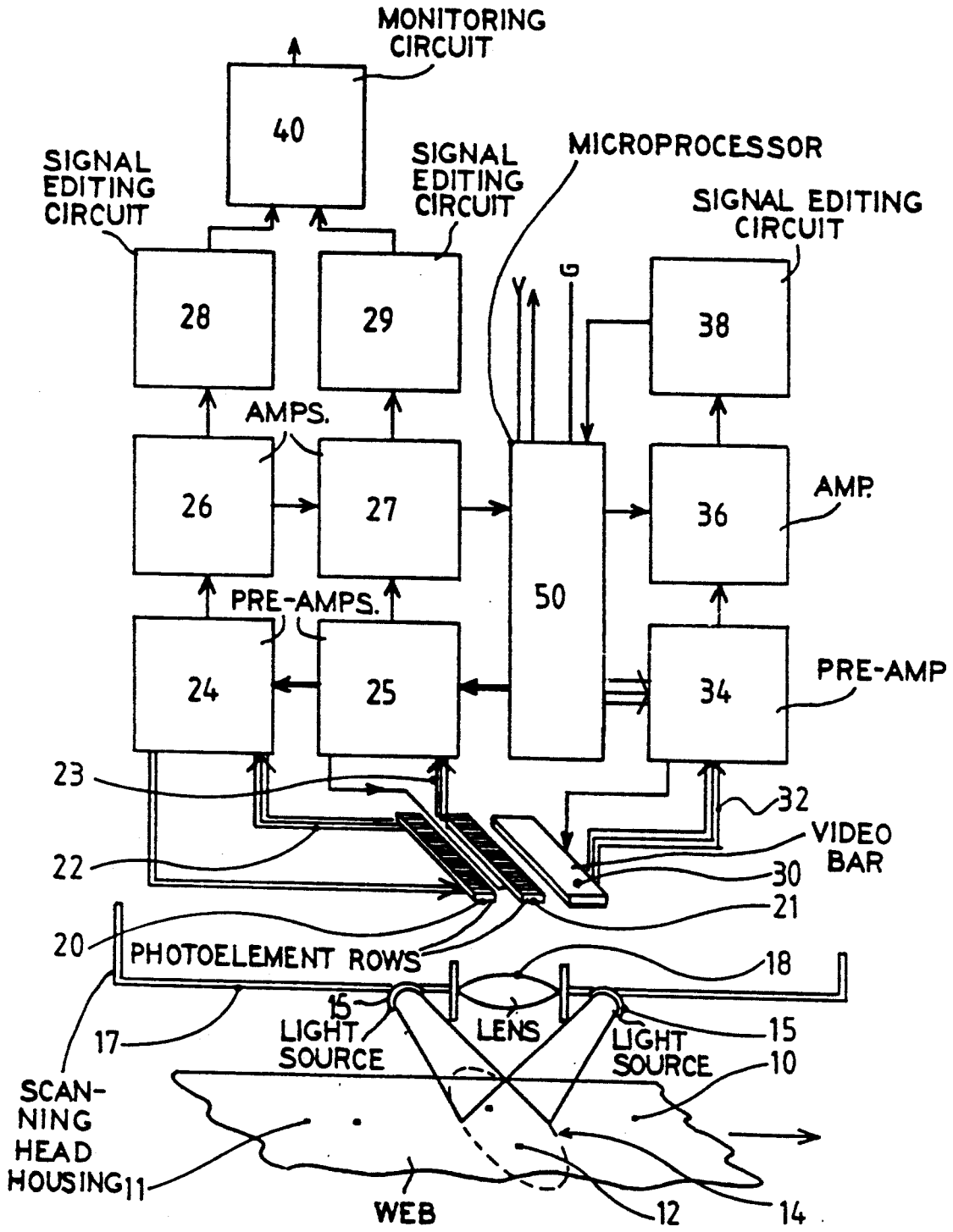
MONITORING CIRCUIT
40
SIGNAL EDITING CIRCUIT
SIGNAL EDITING CIRCUIT
MICROPROCESSOR
SIGNAL EDITING CIRCUIT
28
29
38
Y
G
AMPS.
26
27
50
36
AMP.
PRE-AMPS.
24
25
34
PRE-AMP
23
32
VIDEO BAR
22
30
21
20
PHOTOELEMENT ROWS
18
15
LIGHT SOURCE
LENS
LIGHT SOURCE
15
17
10
SCAN-NING HEAD HOUSING
11
WEB
12
14

REGISTRATION CONTROL DEVICE FOR USE IN A ROTARY PRINTING MACHINE

BACKGROUND OF THE INVENTION

1. Field of the Invention

The present invention is related to a registration control device for use in a rotary printing machine.

2. Description of the Prior Art

Registration control devices used in a rotary printing machine usually employ a head for scanning the registration marks, usually printed in the margin, in order to detect any possible misregistration of the prints in each color. The device then generates correction commands which alter either the track of the paper web or the position of the corresponding plate cylinder.

Known devices of this type, such as described in U.S. Pat. No. 3,653,322, have a scanning head which includes one or several photodiodes for scanning a registration mark which enters an illuminated area and travels under the head. In order to compensate unpredictable sideways misregistration inherent to the high running speed of the paper web, the registration marks have in this context the shape of crossed lines with a width considerably broader than the scanning diameter of the photoelectric cell. For instance, with a cell that has a scanning diameter of 6 mm, the width of the mark will perhaps be of 10 mm in order to leave a margin of 2 mm on either side.

In another such device, described in European Application 0 123 305, the registration marks are triangular and tiny, i.e., about 3 mm large by 6 mm long, in order to save room for the prints. The triangular configuration of these registration marks allows the simultaneous determination of the lengthwise (machine-direction) and sideways (cross-machine direction) misregistration of the corresponding print by means of an analysis based on the emission and intensity of the impulse received. However, despite the reduced scanning surface of the head, i.e., of one millimeter or so, it appears necessary to motorize the sideways positioning of the head in order to be able to compensate for a temporary displacement of the web. This motorization of the positioning of the head results in a heavier structure which has repercussions on the realization cost.

As will be understood, the continuous aim for gaining space on the paper, which aim is achieved by reducing the size of the registration marks to approximately 1 mm in width or less, will create a problem in the sideways misregistration of webs, if such misregistration has an amplitude bigger than the one of the registration marks. Motorized correction becomes practically impossible with such small-sized registration marks, which tend to leave the scanning field of the photoelectric cell too easily, even before the determination of their dimensions. Moreover, it is impossible to give such a little mark a particular shape, i.e., that of a triangle, which would allow a simultaneous detection of lengthwise and sideways misregistration.

PCT applications WO 86/05141 and WO 89/01867 suggest solutions employing video cameras taking a global image of a group of marks in order to determine the misregistration of the various colors by means of a numerical analysis based on this image. Although working satisfactorily with prints running at low speed, these devices reach their limit at higher speed, especially when applied to heliographic printing for which the web paper running speed might amount to 20 m/s. At that speed, the image processing should be effectuated at least ten times quicker than is currently done.

SUMMARY OF THE INVENTION

It is an object of the present invention to provide a register control device for use in a rotary printing machine, of the type functioning on the basis of the scanning of particularly tiny registration marks, i.e., of one square millimeter or below, which ensures a register control as precise as any known devices, but which functions sufficiently quickly to permit a higher running speed of the web.

It is a further object to provide such a device which is able to establish both the lengthwise and sideways misregistration, either by means of marks arranged side by side or by means of consecutive registration marks depending on the surface left available on the web paper.

Another object is to provide a device of this type with a simple design in order to enable its realization at a reasonable cost.

The above objects are achieved in a register control device constructed in accordance with the principles of the present invention, for use in a rotary printing machine, having a head which scans the printed registration marks, the scanning head having a row of discrete photosensitive elements arranged on an axis crosswise to the traveling (machine) direction of the web and in a plane situated above as well as parallel to this web, the head having in the same plane a linear video bar situated parallel to the row of photosensitive elements. Moreover, this device includes a microprocessor which selects the photosensitive element to be used according to the temporary sideways displacement of the web and controls the scanning operations of the linear video bar.

The row of discrete photosensitive elements can consist of about twenty photodiodes with a surface of about 0.7 $mm^2$ arranged nearly every millimeter. Such a row of photodiodes is, for instance, commercially available from Integrated Photomatrix Limited, model IPL 10 220. The linear video bar can be a CCD video component such as is commercially available from Fairchild, model 145DC, which comprises 2,048 photosensitive elements over a width of 20 mm. The advantage of this arrangement is that the photodiodes of the row can be directly selected to emit instantaneously an impulse at the moment a registration mark travels under them, whereas the linear CCD video bar emits a very precise information related to the sideways position of the traveling registration mark.

In a further embodiment of the invention, a second row of discrete photosensitive elements is arranged parallel between the first row of discrete photosensitive elements and the linear video bar. In this arrangement, it becomes possible to analyze registration marks arranged side by side as well as consecutive registration marks with the same scanning head.

The microprocessor can be utilized to determine the running speed of the continuous web on the basis of a registration mark successively detected by a discrete photosensitive element of the first row and then by an element of the second row in order to switch on the linear video bar only at the moment the registration mark travels under the video bar. The linear video bar functions on the principle of integrating light over a period and for a given light intensity. The switching on of the video bar on only an "as needed" basis allows a maximal contrast to be maintained between the element or elements which are unilluminated because of the presence of the registration mark and the other illuminated elements.

Preferably, each row of discrete photosensitive elements is connected to a preamplifying and multiplexing circuit controlled by the micro-processor in order to select the discrete scanning element to be temporarily used. This circuit has its output connected to an amplifier with selectable gain and then to a pulse shaping circuit in order to provide the amplified impulse received at the moment the registration mark travels under the selected discrete photosensitive element, with steeper leading and trailing sides.

Preferably, the output of the video bar is supplied to a preamplifying circuit, whose output is connected to an amplifying circuit with selectable gain. The amplifying circuit output is connected to a pulse shaping circuit in order to provide the impulse received at the moment the registration mark travels under the bar with steeper sides. This impulse is supplied to the microprocessor in order to determine the sideways position of the traveling registration mark and to re-initialize the bar through the preamplifying circuit.

In a preferred arrangement, the plane in which the row or rows of discrete photosensitive elements and the video bar are arranged is spaced from the paper web, with a lens inserted between the web and the plane which projects the image of the registration marks onto the photosensitive elements. This configuration allows the easy installation of illuminating means such as spotlight sources or synchronized flashing sources in order to illuminate the area through which the registration marks will travel.

The above-described device thus practices a process for determining the misregistration on the basis of marks arranged side by side by determining the lengthwise misregistration by measuring the possible distance between the centers of the two impulses both emanating quasi-simultaneously from one of the discrete photosensitive elements selected respectively in the right half and left half of the first or second row, and also for determining the sideways misregistration by comparing the centers of the different positions scanned quasi-simultaneously by the linear video bar. (As used herein "quasi-simultaneously" means in one pass of the same registration marks beneath the photodiode rows and the video bar. Since these components are disposed in succession in the direction of web travel, they will not "see" the marks precisely simultaneously.)

The above-described device more specifically practices a process for determining the misregistration on the basis of consecutive marks by determining the lengthwise misregistration by measuring the possible distance between the centers of the two impulses both emanating from one of the photosensitive elements selected respectively in the first or second row, the distance between the two rows being equivalent to the distance expected between the two registration marks, and for determining the sideways misregistration by comparing the centers of the positions—normally identical—successively scanned by the linear video bar.

DESCRIPTION OF THE DRAWINGS

The single FIGURE is a schematic block diagram of a register control device constructed in accordance with the principles of the present invention.

DESCRIPTION OF THE PREFERRED EMBODIMENTS

The device shown in the drawing includes a scanning head 17 equipped with a lens 18 and with two spotlight sources 15 illuminating an area 14 on a paper web 10 which travels under the said head 17. When the paper web 10 travels through the various color printing stations, the paper web 10 is printed with either registration marks 12 arranged side by side or consecutive registration marks 11. Two rows of photodiodes 20 and 21 as well as a linear CCD video bar 30 situated parallel to one another and crosswise to the traveling direction of the web 10 are arranged behind a lens 18 in a plane parallel to the paper web 10.

Preferably, the focal distance of the lens 18 as well as the respective distances between this lens 18 and the paper web 10, and between the lens 18 and the scanning elements 20, 21 and 30, are determined such a way that these elements receive a non-enlarged image, although it will be understood that depending on the scanning elements 20, 21, 30 used, it could be preferable to modify these parameters in order to obtain a slight enlargement.

The rows of discrete photosensitive elements 20 and 21 are identical and consist of two components marketed by Integrated Photomatrix Limited, model IPL 10 220. This component contains in a housing a row of 22 elements of 0.66 $mm^2$ each, arranged every 1.08 mm. These two rows of photodiodes 20 and 21 are spaced at a distance of, about 20 mm, which corresponds to the normal interval between two consecutive registration marks 11. The photodiodes of the rows 20 and 21 are respectively connected to the inputs of multiplexing circuits 24 and 25 through connection lines 22 and 23. The circuits 24 and 25, commonly available include at an internal preamplifier at each input and connect only one preamplifier output at a time to a second internal amplifying stage by means of an internal selecting circuit controlled by the microprocessor 50.

The selected and preamplified impulse is then directed to an amplifying circuit 26 or 27 with selectable gain, this gain being established through the microprocessor 50 in order to compensate the effects due to the shiny or dull aspect of the paper web or due to the more or less contrasted color, or shine, of the registration marks. The amplified impulse is then applied to a pulse shaping circuit 28 for modifying the sloped sides into steeper sides. This kind of pulse shaping circuit is known to those skilled in the art can comprise a first peak detecting circuit whose output is slightly reduced by means of a resistance bridge before being applied to the positive input of a comparator, the negative input receiving the initial impulse directly. The comparator switches rapidly when the height of the impulse with above the baseline voltage crosses, going lower to higher, a predetermined value.

The output signals of the circuits 28 and 29, which are in the form of two spaced pulses, are then applied to a monitoring circuit 40 which compares the angular displacement by principally taking the midpoint between the impulses as a reference, as described below.

The linear video bar 30 consists of a row of 2,048 detecting elements which are separated by cross-talk-preventing channels and are covered by a passivating layer of silicate dioxide. The photons pass through the layer of silicate dioxide and are absorbed by the individual silicate crystals forming electron/hole pairs. These electrons generated by the photons are accumulated in photosensitive sites. The amount of accumulated electronic charge in every photosensitive site is a linear function of the incident light intensity and of the integration period. A reset signal ends the integration period thereby permitting control of the integration period of every sensitive element. The output signal varies continuously from a minimum corresponding to "dark" thermal noise to a saturation level corresponding to the photoelectric effect of intense illumination.

The video bar 30 has two transfer gates adjacent to the rows of photosensitive elements. The charge packets accumulated in the photosensitive elements are then transferred transport registers through the transfer gates every time the voltage applied to the control input of the transfer gate rises. The charge packets are transferred alternatingly to one or the other register. The transport registers are used to move the charge packets generated by the light in serial mode to a sideways amplifier. A complementary relation between the two transport registers allows recall of the initial chronology of the charge packets in order to create at the output a sequence of video lines.

The video bar 30 is thus a CCD component with load coupling formed by a semi-conductor element in which discrete isolated charge packets are transferred from a position in the semi-conductor to an adjacent position by the sequential action of a row of gates. These charge packets are minority carriers with regard to the substrate of the semi-conductor.

The video output 32 passes through a preamplifying circuit 34 before being amplified in a circuit 36 whose gain can be pre-established, also according to the quality of the paper web and/or of the registration marks. The preamplifying circuit 34 also controls the scanning by the video bar 30, in particular the beginning and end of the integration period, based on a signal to the preamplifying circuit 34 from the microprocessor 30 when "informed" by the signals from the photodiode rows 20 and 21 that the registration marks in question are about to pass beneath the video bar 30.

The video signal from the amplifier 36 comprising one or two impulses is then applied to the pulse shaping circuit 38, identical to the circuits 28 and 29, which enhances the contrast of the existing impulses by steepening the sides thereof before supplying them to the micro-processor 50 for an analysis.

The device described above functions in the following way:

In the case of a succession of registration marks 12 respectively printed side by side along the successive printed motifs, the row of photodiodes 20 is virtually divided to two, the microprocessor 50 selecting in the multiplexing circuit 24 two diodes, i.e., one in each half, corresponding to the positions of the expected passage of the marks 12, as defined in an initializing phase or by prior measurements. If the printed motifs are accurately registered, the registration marks 12 always appear spaced side by side by the same distance and will simultaneously influence their respective photodiodes in such a way that the circuit 40 will find no angular displacement between the spaced amplified impulses. In case of misregistered printed motifs, an angular displacement will then appear between the impulses received which will allow a determination to be made as to whether the cylinder in question of the rotary printer is causing the web to lead or lag. When the registration marks 12 arranged side by side travel quasi-simultaneously under the linear video bar 30, each of the marks will influence a distinct area of the photosensitive elements resulting in two impulses at the output of the video signal whose interval can be precisely measured by the microprocessor 50 on the basis of the centers of the square amplified impulses. This measurement can be effectuated, for instance by counting the number of impulses emanating from the inner clock of the microprocessor 50, switched on by a first impulse and off by a second one.

In the case of two consecutive registration marks 11, the micro-processor 50 gives the multiplexing circuits 24 and 25 the command to connect in line one photodiode from the bars 20 and 21, respectively. The distance between these two photodiode bars 20 and 21 is equivalent to the distance expected between the registration marks 11, thus the two selected photodiodes should simultaneously generate an impulse, which will cause the comparative circuit 40 to find no angular displacement. If an angular displacement is found, the measurement of the angular displacement will allow a determination to be made as to whether the printed motif in question is leading or lagging.

For measuring the sideways misregistration, the linear video bar 30 scans the first registration mark 11 generating a first video signal, then re-initializes itself in order to scan the second registration mark. The period the video bar 30 requires to effectuate a scanning and then a re-initialization being of about 500 micro-seconds with an inner clock functioning at 4 MHz. The video bar 30 can thus scan separately each of the registration marks which, in the case of a distance of 22 mm for a web running speed of 20 m/s, follow one another at an interval of one millisecond. The microprocessor 50 then compares the sideways position of each of the registration marks which can be effectuated by counting the number of impulses emanating from a clock switched on by a start and off by the center of the square amplified impulse corresponding to the passage of this registration mark.

As is clear from this description, the device according to the invention can easily detect position misregistration of particularly tiny marks, i.e., below or equivalent to a square millimeter, printed on a web running at high speed, i.e., at 20 m/s or even faster. Because all fragile elements, i.e., the electronic detectors, can be contained within a rigid and airtight housing 17 only exposing the lens and light sources, this device can withstand an industrial environment. The majority of the optical, opto-electric or electronic components which are used in this device are commercially available so that the realization cost remains within a reasonable price range.

Although modifications and changes may be suggested by those skilled in the art, it is the intention of the inventors to embody within the patent warranted hereon all changes and modifications as reasonably and properly come within the scope of their contribution to the art.

I claim as my invention:

1. An apparatus, for use in a rotary printing machine having a traveling web with registration marks disposed thereon, for determining misregistration of said web, said apparatus comprising:

a scanning head having a row of individually selectable discrete photosensitive elements and a video bar, both disposed in a plane parallel to said web and both extending parallel to the cross-machine direction for scanning said registration marks as they pass beneath said scanning head, and each of said row of discrete photosensitive elements and said video bar generating respective electrical signals upon scanning said registration marks;

microprocessor means connected to said row of discrete photosensitive elements for selecting, dependent on a current amount of cross-machine displacement of said web, at least one photosensitive element in said row to be used to detect misregistration of said web, and to said video bar for controlling scanning of said web by said video bar;

first processing means, connected to said row of discrete photosensitive elements and to said microprocessor means, for generating a signal corresponding to machine-direction misregistration of said web from said electrical signal from said row of photosensitive elements; and second processing means, connected to said video bar and to said microprocessor means, for generating a signal corresponding to cross-machine misregistration of said web from said electrical signals from said video bar quasi-simultaneously with the generation of said signal corresponding to machine-direction misregistration by said first processing means.

2. An apparatus as claimed in claim 1 wherein said registration marks are disposed successively on said web in the machine-direction, and wherein said scanning head has a further row of discrete photosensitive elements disposed in said plane, in said scanning head, extending in the cross-machine direction parallel to said row of discrete photosensitive elements for additionally scanning said registration marks as they pass beneath said scanning head and for generating a further electrical signal upon scanning said registration marks, said further row of discrete photosensitive elements being connected to said microprocessor means and to said first processing means, wherein said microprocessor means is a means for selecting one photosensitive element in each of said row of discrete photosensitive elements and said further row of discrete photosensitive elements for scanning said registration marks, and wherein said first processing means is a means for generating said signal corresponding to said machine-direction misregistration of said web from said electrical signal from said row of discrete photosensitive elements and from said further electrical signal from said further row of discrete photosensitive elements.

3. An apparatus as claimed in claim 2 wherein said microprocessor means includes means for determining the traveling speed of said web by the time elapsed between the generation of said electrical signal from said row of discrete photosensitive elements and from said further electrical signal from said further row of discrete photosensitive elements, and wherein said microprocessor means controls scanning of said web by said video bar by causing said video bar to scan said web only when said registration marks are beneath said video bar, based on said traveling speed of said web.

4. An apparatus as claimed in claim 2 wherein said electrical signal generated by said row of discrete photosensitive elements and said further electrical signal generated by said further row of discrete photosensitive elements are respective pulses spaced a distance apart, and wherein said first processing means includes means for identifying a midpoint between said pulses as a basis for generating said signal corresponding to said machine-direction misregistration of said web.

5. An apparatus as claimed in claim 4 wherein said first processing means further comprises:

multiplexer means, controlled by said microprocessor means, for passing electrical signals therethrough corresponding to respective photosensitive elements in said row of discrete photosensitive elements and in said further row of discrete photosensitive elements selected by said microprocessor means;

preamplifier means for preamplifying said electrical signals after passing through said multiplexer means;

a selectable gain amplifier for amplifying said electrical signals after passing through said preamplifier means; and signal editing means for steepening sides of said pulses before supplying said pulses to said means for identifying a midpoint.

6. An apparatus as claimed in claim 1 wherein said registration marks are disposed on said web side-by-side in the cross-machine direction and wherein said microprocessing means is a means for selecting a photosensitive element in a right side of said row of discrete photosensitive elements and a different photosensitive element in a left side of said row of discrete photosensitive elements to be used to detect misregistration of said web.

7. An apparatus as claimed in claim 6 wherein the selected photosensitive element in said right side of said row of discrete photosensitive elements and the selected photosensitive element in the left side of said row of discrete photosensitive elements generate said electrical signals in the form of respective pulses spaced from each other, and wherein said first processing means includes means for identifying a midpoint between said pulses as a basis for generating said signal corresponding to said machine-direction misregistration of said web.

8. An apparatus as claimed in claim 7 wherein said first processing means further comprises:

multiplexer means, controlled by said microprocessor means, for passing electrical signals therethrough corresponding to said discrete photosensitive elements in said row of discrete photosensitive elements selected by said microprocessor means;

preamplifier means for preamplifying said electrical signals after passing through said multiplexer means;

a selectable gain amplifier for amplifying said electrical signals after passing through said amplifier means; and signal editing means for steepening sides of said pulses before supplying said pulses to said means for identifying a midpoint.

9. An apparatus as claimed in claim 1 wherein said video bar generates said electrical signals in the form of respective pulses corresponding to said registration marks passing beneath said video bar, and wherein said second processing means includes means in said microprocessor means for identifying a midpoint between said pulses corresponding to said registration marks passing beneath said video bar as a basis for generating said signal corresponding to said cross-machine misregistration of said web.

10. An apparatus as claimed in claim 9 wherein said second processing means further comprises signal editing means for steepening sides of said pulses before supplying said pulses to said means for identifying a midpoint.

11. An apparatus as claimed in claim 1 wherein said scanning head further includes a lens disposed between said web and said plane.

12. A method for determining misregistration of a traveling web in a rotary printing machine, said web having side-by-side registration marks thereon extending in a cross-machine direction, said method comprising the steps of:

scanning said registration marks with a single row of discrete photosensitive elements and a video bar, both disposed in a plane parallel to said web and both extending parallel to the cross-machine direction;

during scanning of said registration marks, selecting one photosensitive element in a right half of said row and selecting another, different photosensitive element in a left side of said row;

generating respective, spaced pulses from said selected photosensitive elements in said left and right halves of said row corresponding to the passage of said registration marks beneath said row;

identifying a midpoint between said pulses from said selected photosensitive elements and generating a signal corresponding to machine-direction misregistration of said web based on the identification of said midpoint between said pulses from said selected photosensitive elements in said left and right halves of said row;

generating two spaced pulses from said video bar corresponding to the passage of said registration marks beneath said video bar; and identifying a midpoint between said pulses from said video bar, and generating a signal corresponding to cross-machine misregistration of said web based on the identification of said midpoint between said pulses from said video bar.

13. A method for determining misregistration of a traveling web in a rotary printing machine, said web having successive registration marks thereon extending in a machine-direction, said method comprising the steps of:

scanning said registration marks with a two row of discrete photosensitive elements and a video bar, all disposed in a plane parallel to said web and all extending parallel to the cross-machine direction;

during scanning of said registration marks, selecting one photosensitive element in each of said rows;

generating respective, spaced pulses from said selected photosensitive elements in said rows, corresponding to the passage of said registration marks beneath said rows;

identifying a midpoint between said pulses from said selected photosensitive elements in said row and generating a signal corresponding to machine-direction misregistration of said web based on the identification of said midpoint between said pulses from said selected photosensitive elements in said rows, generating two spaced pulses from said video bar corresponding to the passage of said registration marks beneath said video bar; and identifying a midpoint between said pulses from said video bar, and generating a signal corresponding to cross-machine misregistration of said web based on the identification of said midpoint between said pulses from said video bar.

* * * * *